United States Patent [19]

Moraht et al.

[11] Patent Number: 4,915,013

[45] Date of Patent: Apr. 10, 1990

[54] CONTROL VALVE MEANS FOR PRESSURIZED AIR-OPERATED DEVICES FOR DRIVING FASTENERS INTO WORKPIECES

[75] Inventors: Roland Moraht; Manfred Bähnke, both of Hamburg, Fed. Rep. of Germany

[73] Assignee: Joh. Friedrich Behrens AG, Ahrensburg, Fed. Rep. of Germany

[21] Appl. No.: 217,613

[22] Filed: Jul. 11, 1988

[30] Foreign Application Priority Data

Jan. 30, 1988 [DE] Fed. Rep. of Germany ..... 8801114

[51] Int. Cl.[4] ..... F01L 25/02

[52] U.S. Cl. ..... 91/307; 91/308; 91/309; 91/317; 91/461; 227/130

[58] Field of Search ..... 227/130; 91/417 A, 307, 91/308, 309, 317, 461

[56] References Cited

U.S. PATENT DOCUMENTS

| | | | |
|---|---|---|---|
| 3,278,103 | 10/1966 | Juilfs | 91/308 |
| 3,427,928 | 2/1969 | Bade | 91/308 X |
| 3,547,003 | 12/1970 | Ramspeck | 91/308 X |
| 3,583,496 | 6/1971 | Fehrs | 91/308 X |
| 3,808,620 | 5/1974 | Rothfuss et al. . | |
| 4,304,349 | 12/1981 | Novak et al. . | |
| 4,319,705 | 3/1982 | Geist et al. . | |

FOREIGN PATENT DOCUMENTS

| | | |
|---|---|---|
| 1603979 | 12/1970 | Fed. Rep. of Germany . |
| 1603839 | 6/1973 | Fed. Rep. of Germany . |
| 1908150 | 9/1975 | Fed. Rep. of Germany . |
| 3222949 | 6/1983 | Fed. Rep. of Germany . |

*Primary Examiner*—Edward K. Look
*Attorney, Agent, or Firm*—Faegre & Benson

[57] ABSTRACT

Control valve means for a driving tool operated with compressed air for the driving of fasteners into workpieces. Through a specific design of the main and the auxiliary valve and through a connection to the piston return chamber the control of the valves are brought into synchronization with the movement of the working piston. By this, high repetition frequencies can be achieved. Further, in the mode "automatic operation" also single shot operation is possible.

15 Claims, 6 Drawing Sheets

CONTROL VALVE MEANS FOR PRESSURIZED AIR-OPERATED DEVICES FOR DRIVING FASTENERS INTO WORKPIECES

The invention refers to a control valve means for a device for driving fasteners into a workpiece according to the preamble of claim 1.

Known devices of this kind serve for the driving-in of nails, staples or the like. The working piston for the actuation of the driving-in ram is pneumatically operated. The release occurs by means of a trigger lever or the like which actuates a trigger valve. The trigger valve in turn controls a control valve which in its opened position interconnects the stroke chamber for the working piston and a source of pressurized air while in its closed position vents the working stroke chamber.

With such devices usually a single driving-in stroke is released when the trigger valve is manually operated. The working piston only arrives at its upper deadpoint position when the release is terminated. In a plurality of cases, a continuous automatic driving-in of fasteners is desired without an actuation per driving-in stroke. For this, a specific control valve means is required to automatically place the control valve in its closed position and to initiate the piston return if the driving-in stroke is terminated in order to commence a new working cycle.

From the German patent specification No. 16 03 979 a control valve is known wherein a control piston is urged by a spring into its closed position. A control valve piston is coaxial of the control piston which is displaced into its opened position by the control valve piston upon a respective pressure supply. The pressure supply to the control piston is controlled by a reverse control valve by which an effective area of the control valve is selectively connected to atmosphere or pressurized air, respectively. It is a disadvantage of the known device that the return spring of the control piston is a part subject to wear which becomes tired after a predetermined number of cycles. It is further disadvantageous that the control piston is brought into its opened position by means of the control valve piston. By this, the control valve piston and also the control piston are mechanically heavy loaded. Besides, undesired noise is caused. It is finally particularly disadvantageous that the reverse control of the automatic valve is not in synchronization with the movement of the working piston. The danger exists that the reverse process is already initiated before the working piston has completed its working stroke. Therefore, the fastener may not be applied with sufficient energy and may not be driven far enough into the workpiece. The further danger exists that the working stroke chamber is already supplied with pressurized air before the working piston has reached its upper deadpoint position. In this case, the working piston is also not driven with sufficient energy in the subsequent stroke. It may further happen that the working piston does not drive out a fastener at all since it does not approach sufficiently the upper deadpoint position. By this, the working ram prevents a further fastener from entering the ram channel.

From the German patent specification No. 1 603 839 a control valve means is known wherein the control chamber associated with a main control valve spool is connected to the piston return chamber via an additional valve, this connection being controlled by an auxiliary valve spool. The piston return chamber as is known serves for displacing the piston from the lower deadpoint position to the upper deadpoint position in that it is filled with pressurized air when the working piston substantially has reached its lower deadpoint position. The return chamber is connected to the cylinder through a bore below the piston in its lower deadpoint position so that the air stored in the return chamber can effect the return stroke. In the known control valve means, a portion of the pressurized air is branched-off in order to move the main valve spool in its closed position. The pressure conditions in the piston return chamber are depending from various factors, e.g. the friction of the working piston, the sealing elements etc. so that reproducible pressures cannot be achieved. The additional valve thus does not reproducibly open upon a predetermined position of the working piston. In the known valve means there is also no exact synchronization between the movement of the working piston and the switching operation of the control valve means. The displacement of the main valve spool toward its closed position requires a certain pressure and a certain volume which occasionally are then not available for the return of the working piston. With the known valve, the danger exists that the reverse operation is too rapid so that the working piston does not reach its upper deadpoint position before the working stroke chamber is again connected to the source of pressurized air. Finally, the known valve necessitates a great number of dynamically loaded sealing rings and a return spring in the additional valve, respectively. Sealing rings and springs are parts to wear out which have to be replaced from time to time.

The same difficulties as have been explained with respect to the above valve arrangement yield from the known valve arrangement according to the German patent specification No. 3 222 949 wherein the return chamber of the driving tool is immediately connected to an effective area of the main valve which as so-called head valve is arranged above the working cylinder coaxial of the working piston. Such a valve arrangement is rather simply structured since it works without an auxiliary valve, however, the repetition frequency cannot be accurately changed. Further, a long distance air passage is connected between the return chamber and the respective effective area of the main valve which is disadvantageous with respect to a rapid reverse control. Therefore, the known valve permits only relative small repetition frequencies. Finally, the reverse control occurs only if the pressure has been nearly completely built up since the pressure difference are very small.

The U.S. Pat. No. 3,808,620 disclose a less expensive valve having a main valve which is also formed as head valve. The auxiliary valve spool is displaceably located within a sleeve which in turn is displaceably supported in the housing of the tool. For the single shot operation, the sleeve remains in a predetermined end position. For the repetition operation, the sleeve is supplied by the pressure in the piston return chamber and is displaced relative to the auxiliary valve spool. By this, the auxiliary valve spool is returned in the original position whereby the main valve is reversed. The known valve arrangement has also some disadvantages. The sleeve oscillating in the repetition operation is relatively large and thus has a relative large mass which is not favourable for high repetition frequencies. The oscillating sleeve as well as the auxiliary valve spool is provided with a plurality of dynamically loaded O-rings which are subjected to relatively heavy wear. Further, the O-rings require a higher reverse power. In the known valve arrangement, the surface differences are relatively small. Therefore, a reverse control happens only upon a nearly complete pressure built up or pressure relief. With higher repetition frequencies, the danger exists that the working piston is already subjected to pressurized air during its return stroke.

A control valve means of the kind mentioned above is known from the German patent specification No. 19 08 150. An auxiliary valve spool is shaped as a stepped piston which confines a control space together with a piston portion, the control space being connected with the pressure passage in the opened valve position through a conduit controlled by the main valve spool and connected to a vent passage in the closed valve position. The auxiliary valve spool in turn controls the pressure supply to the main valve spool. The reversal of the main valve spool commences only when the main valve spool has completely reached its opened position so that a sufficient pressure can be built up in the working stroke chamber in order to operate the working piston. A further working cycle is initiated only when almost no air is flowing out of the working cylinder during the piston return stroke. In the known valve, the discharged air is introduced in a further control space through a controllable passage so that the venting thereof can only occur when the air flowing thereagainst is nearly or completely vented of the working stroke chamber. By these measures an adaptation to the movement of the working piston is achieved in that the working piston always makes a complete working and return stroke. However, it has turned out that at higher frequencies the intended synchronization cannot be achieved. The time duration between the reversals is substantially predetermined by the connection passages which for instance may have restrictions or the like. If the flow areas are too small or too large, it may happen that the working piston is pressure-relieved prior to its upper deadpoint position or is subjected to pressure prior to its upper deadpoint position. It is further disadvantageous in the known control valve arrangement that a great number of dynamic sealing rings are necessary which have to be regarded as parts subject to wear.

It is the object of the invention to provide a control valve means for pneumatically driven tools for driving-in fasteners into workpieces which have a minimum of parts subject to wear and which above all secure an exact adaptation of the reversal operations to the movement of the working piston also with high frequencies in the so-called repetition operation.

This object is attained by the features of the characterizing portion of claim 1.

The control valve means according to the invention does not need dynamically loaded spring means similar to the valve means described above. The trigger valve or the tappet thereof can be provided with a pressure spring, however, the spring is not dynamically loaded. The control valve means according to the invention needs only a very small number of dynamically loaded sealing rings so that it has minimum parts subject to wear and thus allows larger maintenance intervals.

Similar to the known control valve means the invention necessitates merely two valve pistons or spools, the main valve spool controlling the passage leading to the working stroke chamber while the auxiliary valve spool controls the pressure supply to the larger effective area of the main valve spool. It is significant to the invention that the second effective area of the auxiliary valve spool is immediately connected to the piston return chamber. This connection can be defined by a simple transverse bore and preferably includes a restriction or throttle which for example can be varied by an adjusting screw or a needle in order to change the flow area. In case the bore is completely closed, the device according to the invention is ready for a single shot operation. The flow area adjusted by the throttle in the bore determines the repetition frequency of the control valve for its automatic operation.

The trigger valve in its unloaded or non-actuated condition, respectively, takes care that the larger effective area of the main valve spool is subjected to the pressure of the source of pressurized air, e.g. of the pressure in the reservoir which is located in the gripping portion of the tool. By this, the main valve spool remains continuously in its closed position and locks the connection between the pressure source and the working stroke chamber. By actuation of the trigger valve the larger effective area of the main valve spool is vented. The auxiliary valve spool can remain in its position. For example, a space connected to atmosphere by the actuation of the trigger valve may be continuously connected to the larger effective area of the main valve spool in the original position of the auxiliary valve spool. The pressure on the smaller effective area of the main valve spool thus results in its displacement in its opened position wherein the passage between the pressure source and the working stroke chamber is opened. The working piston is downwardly driven and drives a fastener into a workpiece. When the working piston reaches its lower position (lower deadpoint position), pressurized air can flow into a return chamber surrounding the cylinder through a bore. Some air from the return chamber flows to the second effective area of the auxiliary valve spool through the mentioned bore and the throttle located therein. The auxiliary valve spool then is displaced into its second position wherein it interconnects the larger effective area of the main valve spool and the pressure source. Thereafter, the main valve spool is again moved into its closed position and thus separates the connection between the pressure source and the working stroke chamber and connects the latter to atmosphere. The air stored in the return chamber now urges the piston toward the upper deadpoint position. During the total return interval, a certain pressure is prevailing in the return chamber so that the second effective area of the auxiliary valve spool is supplied with this pressure and prevents the return of the auxiliary valve spool to its original position. Upon sign reversal of the pressure difference, the air under pressure then flows back to the return chamber from the second effective area of the auxiliary valve spool and supports the return effect. If the second effective area of the auxiliary valve spool is dimensioned sufficiently large, it can be easily achieved that the auxiliary valve spool returns to its first or original position only then, when it is secured that the working piston has reached its upper deadpoint position. Some time or other the auxiliary valve spool is returned to its original position by the pressure of the pressure source so that again the larger effective area of the main valve spool is connected to atmosphere, and a new working cycle can commence.

As can be seen, a reversal in the automatic valve of the invention can be accomplished only when the working piston has actually reached its upper deadpoint position. Conversely, the working stroke chamber of the working piston is only connected to the pressure source when it has arrived at the upper deadpoint position. With the control valve according to the invention, the available energy is exploited to the maximum to effectively drive-in a fastener into a workpiece also and above all in the repetition operation thereof.

Similar to the control valve means described above, the valve according to the invention includes a fixedly arranged control sleeve which sealingly cooperates with a central of the main valve spool. The control sleeve according to the invention can be provided with a radial flange by which the main control space faced to the larger effective area of the main valve spool is confined. The auxiliary valve spool according to the invention is displaceably guided in the bore of the control sleeve.

The second effective area of the auxiliary valve spool which is selectively subjected to the pressure of the piston return chamber preferably is much larger than the first effective area. If further the auxiliary valve spool is provided with an effective area which is continuously subjected to the pressure of the pressure source, the second effective area is dimensioned at least twice of the first effective area continuously subjected to the pressure of the pressure source. By this, it is secure that during the return stroke of the piston the auxiliary valve spool remains in its position wherein the control space of the main valve spool is connected with the pressure source. Only when the pressure in the piston return chamber is nearly completely reduced to a fraction of the maximum pressure, the auxiliary valve spool may be displaced to its first position initiating the opening of the main valve so that the working piston can be pressurized to carry out a fresh working stroke. By this it is secured that the piston reaches its upper deadpoint position before a new working stroke is initiated.

The first effective area of the auxiliary valve spool preferably is defined by a piston portion. A further piston portion of the auxiliary valve spool is sealingly arranged in the bore of the control sleeve. The described piston portions, however, are such that only one of both portions sealingly cooperates with the bore of the control sleeve. The piston portions are smoothly cylindrical and formed without sealing elements so that sealings subject to wear can be eliminated in view of the auxiliary valve spool. Only the piston portion defining the second effective area is sealed in the associated bore, preferably by an O-ring. The auxiliary valve spool thus is extremely easy run which is very advantageous to achieve high repetition frequencies up to 2000 per minute.

According to a further embodiment of the invention, the auxiliary valve spool can consist of two parts, one part including the cylindrical portion cooperating with the control sleeve and the other having the second effective area. Such separation is advantageous since it is not prerequisite that the lower part must be exactly coaxially aligned with the upper part so that different relatively offset positions of the valve bores in the housing and the valve cover can be allowed. This means that the tolerances for the manufacture could be relatively rough.

In the valve arrangement described, the frequency for the automatic operation can be continuously changed by changing the throttle between the piston return chamber and the auxiliary valve spool until finally only single shots can be released. In practice, for example in upholsteries, it often happens that a so-called mixed operation is required, i.e. first some staples are driven in by single shot operation to accurately fix a lining. Thereafter, the work is continued under automatic operation with high frequencies. For the change from the single shot to the automatic operation for example a screw has to be turned about three or four turns. This needs some time. Therefore, an embodiment of the invention provides that a bore is provided connected to the second effective area directed to the trigger of the trigger valve which bore in the non-actuated position of the trigger is connected to atmosphere. A portion of the trigger bears a sealing element which upon actuation of the trigger sealingly closes the bore. The relation of the trigger valve to the trigger is such that after a first length of travel, the trigger actuates the trigger valve in order to initiate a shot, the bore beneath the second effective area, however, remaining still opened. Despite of the automatic position of the throttle in the passage to the second effective area, the automatic operation is suppressed, and a fresh single shot can be released only if the trigger has been released and again actuated. If the trigger is actuated, after a second length of travel following the first length, the sealing element closes the bore, and the tool operates automatically. The described arrangement is preferably dimensioned such that the operator if actuating the trigger, e.g. a release lever, feels two points of action, the first thereof can be relatively easy overcome while the second is felt as a more or less significant stop.

Summarizing it can be stated that the valve according to the invention needs a minimum of movable parts and secures an exact adaptation to the run of the working piston. Even with highest repetition frequencies, no loss of striking energies is occurring by the switching of the valve during the downward and upward movement of the working piston, rather, the piston return is initiated only when a strike has been accomplished. A switching to the next strike is accomplished only when the piston has reached its upper deadpoint position. The valve according to the invention also functions with a minimum of parts subject to wear or parts, respectively, which have a long life time in order to avoid a failure also with highest repetition frequencies over a longer time interval. In particular, loaded springs and dynamically high loaded sealing elements (O-rings) are eliminated. The valve according to the invention is continuously variable over a long variation distance from a single shot up to the maximum limit, e.g. 30000 per minute. Furthermore, the valve according to the invention is structured such that it can be mounted in existing houses of tools without the necessity of particular measures for adaptation.

An embodiment of the invention is described hereinafter along drawings wherein

Figure 1:
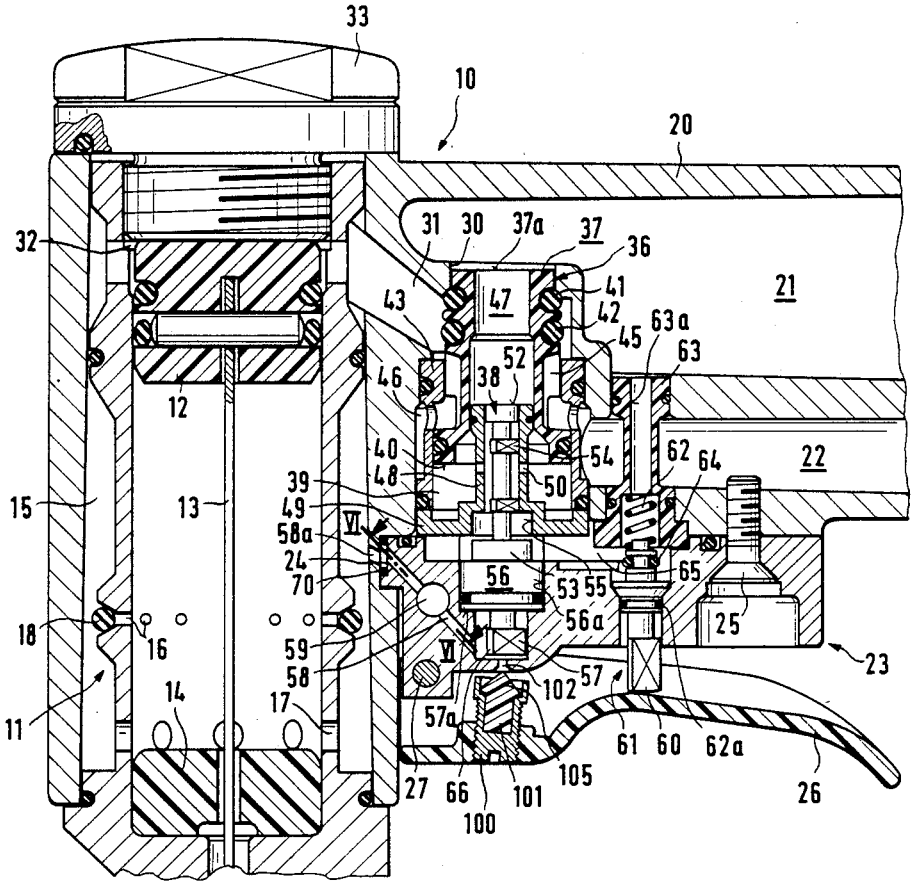
FIG. 1 shows a cross section through a control valve means according to the invention in the non-actuated state.

The driving tool partially shown in cross section in the FIGS. 1 to 5 comprises a housing 10 and a working cylinder 11 which receives a working piston 12 which is connected to a driving ram 13. A stop ring 14 is arranged at the lower end of the working cylinder 11. The working cylinder 11 is surrounded by a piston return chamber 15 which is connected to the working cylinder 11 through first radial bores 16 and second radial bores 17, the bores 16 being closed by an O-ring 18 at the end facing the return chamber 15, thus forming a check valve.

The housing 11 includes a gripping portion 20 wherein a reservoir 21 for compressed air is formed, the reservoir for example being connected to a source of compressed air through an air hose (not shown). Further, a vent passage 22 is formed in the gripping portion 20. At the end of the gripping portion 20 facing the cylinder, a valve plate 23 is mounted at the lower side of the gripping portion, the valve plate 23 having a projection 24 engaging a corresponding recess of housing 10. The valve plate is screwed to the gripping portion 20 by a screw 25 which is countersunk in the valve plate 23. The valve plate 23 at the lower side thereof supports a trigger lever 26 which is pivotally supported as shown at 27.

A bore 30 in the gripping portion 20 is in communication with a passage 31 which leads to a working stroke chamber 32 of cylinder 11. The working stroke chamber 32 is closed by a lid plug 33 from above. The bore 30 receives a control valve 36. It includes a main valve spool 37 and an auxiliary valve spool 38. The main valve spool 37 is designed as differential piston having an effective area 37*a* at one end face associated with the reservoir 21 and a larger effective area opposite to the first effective area associated with a main control space 39. The piston portion of the main valve spool 37 having the effective area 37*a* includes two axially spaced O-rings 41, 42, O-ring 41 cooperating with an upper valve seat by which the communication between passage 31 and reservoir 21 is interrupted. The lower O-ring 42 cooperates with a stepped sleeve 43 which is sealingly received by the bore 30. The bore of the sleeve slidingly and sealingly receives the piston portion of the main valve spool 37. In the position of the main valve spool 37 shown in FIG. 1, the passage 31 is connected to an annular space 45 surrounding the main valve spool 37, the annular space 45 being in communication with an annular space 46 surrounding the sleeve 43 through radial bores in sleeve 43, the annular space 46 being in continuous communication with the vent passage 22. The working stroke chamber 32 thus is under atmospheric pressure.

The central bore of the main valve spool 37 sealingly and slidingly receives the upper end of a control sleeve 48 which has a radial flange 49 sitting in an enlarged portion of the bore 30. Control sleeve 48 has a plurality of radial bores 50 interconnecting the bore of the control sleeve 48 and the main control space 39.

Figure 4:
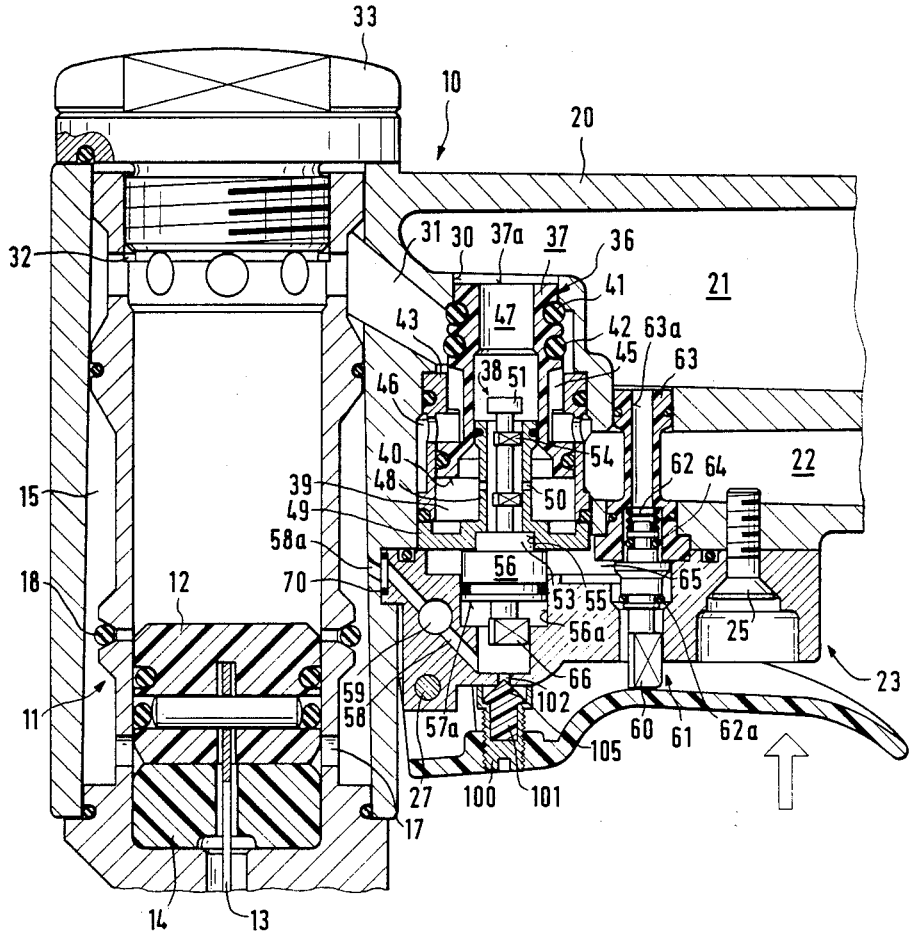
FIG. 4 shows a similar valve means as FIG. 1, however, in a second phase after actuation.
Figure 5:
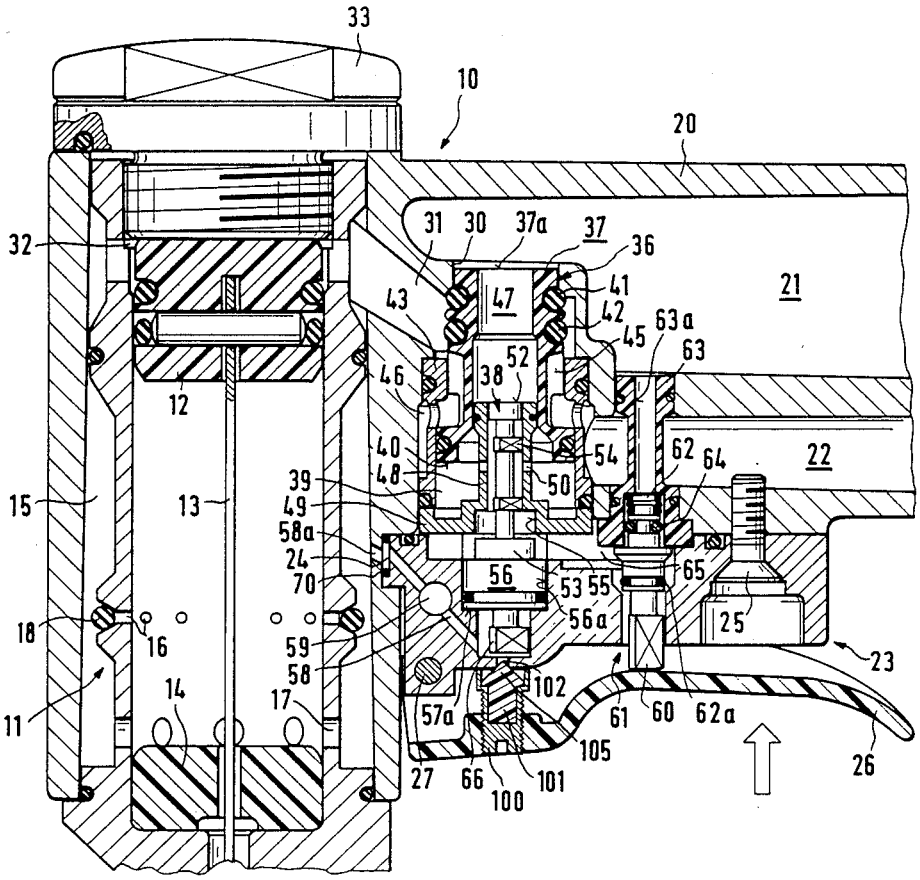
FIG. 5 shows a similar valve means as FIG. 1, however, in a third phase after actuation.

The radial flange 49 engages sleeve 43 from below and is in turn retained from below by valve plate 23. The bore of sleeve 48 receives the upper portion of a ported auxiliary valve spool 38. This is comprised of an upper smooth cylindrical portion 51 having an effective area 52 which is associated with the reservoir 21 through bore 47 of main valve spool 37. The upper portion of the auxiliary valve spool comprises further a smooth cylindrical portion 53. The rod therebetween has a triangular cross section as shown at 54. By this, a passage is formed between the portions 51 and 53 confined by the rod 54 and the bore wall of control sleeve 48. The bore of control sleeve 48 has an enlarged portion 55 in the area of flange 49 in which the smooth cylindrical portion 53 can be sealingly slided. The distance between the smooth cylindrical portions 51, 53 is such that either the upper smooth cylindrical portion 51 is sealingly sitting in the bore of the control sleeve while the portion 53 freeing the bore portion 55 or the smooth cylindrical portion 53 is sitting in the bore portion 55, when the smooth cylindrical portion 51 extending beyond the control sleeve 48 as much as permitting a communication of the passage around the valve rod 54 with the bore 47 of the main valve spool and thus with reservoir 21 (FIG. 4).

The lower portion of the auxiliary valve spool 38 is located in a bore 56*a* of valve plate 23. It comprises a valve piston portion 56 which is sealingly slidable in bore 56*a*. A piston portion 57 having a polygonal cross section—preferably triangular—is sitting in a corresponding bore of valve plate 23. The lower portion of the auxiliary valve spool 38 has an effective area 57*a* and a polygonal effective area 66 which both are in communication with return chamber 15 through an oblique bore 58 in valve plate 23.

A tappet 60 of trigger valve 61 cooperates with the trigger lever 26. It is supported by the pressure in the gripping portion 20 and urged toward the trigger lever 26 by a spring 62 in a bore 63*a* of an insert member 63. An O-ring 62*a* closes the bore in the valve plate 23 from below. The tappet 60 which in the lower portion is triangular in cross section, comprises a further sealing ring 64 at the upper end thereof which cooperates with the bore 63*a* in member 63 when the tappet is lifted by means of the trigger lever 26. By this, a control space 65 is cut off from reservoir 21 which in the position of the auxiliary valve spool 38 shown in FIG. 1 is in communication with bore 56*a*.

The described valve arrangement operates as follows.

FIG. 1 illustrates the non-actuated state. The trigger lever 26 is shown in a non-actuated position. In this position of trigger valve 61, chamber 65 has the same pressure as reservoir 21 since a communication is established through bore 63*a*. By this, also in bore 56*a* and in the bore portion 55 the pressure of reservoir 21 is prevailing which can expand also to the main control space 39 through the radial bores 50. Since the effective area 40 of the main valve spool 37 is larger than the effective area 37*a* facing the reservoir 21, the main valve spool is retained in the closed position shown in FIG. 1 wherein the connection passage 31 is cut off from compressed air and connected to the outlet passage 22 through the annular space 45. The piston 12 is in its upper deadpoint position. As can be easily seen, the main valve spool 37 is also held in its closed position when the upper portion of the auxiliary valve spool 38 is in its upper position (which for example is shown in FIG. 4). The cylindrical portion 51 then is beyond the bore of control sleeve 48 so that the passage between the connection rod 54 and the control sleeve 48 is also in communication with compressed air through the bore 47 of main valve spool 37, thus, the compressed air expanding into the main control space 39 through the radial bores.

If the trigger lever 26 is actuated in the direction of the arrow (FIG. 3), the valve tappet of trigger valve 61 is lifted and the sealing ring 64 connected to the valve tappet enters the lower portion of bore 63*a* of member 63 so that the compressed air is cut off. Contemporarily, the sealing ring 62*a* leaves the associated bore of valve plate 23. Since the valve tappet in the lower area is polygonal in cross section, preferably triangular, a communication of control space 65 with atmosphere is established. A communication of main control space 39 with atmosphere through bores 56*a*, 55 as well as through radial bores 50 is also established. The pressure effective on the smaller effective area 37*a* of main valve spool 37 therefore displaces the main valve spool 37 into the opened position shown in FIG. 3 wherein the O-rings 41, 42 cooperate with a bore of the sleeve-like insert 43 and thus interrupting the communication of the passage 31 with the outlet passage 22. By this, compressed air enters the working stroke chamber 32 and drives the working piston 12 downwardly in order to accomplish a working strike on a fastener.

In its lower deadpoint position, the working piston 12 with its lower end surface impinges the stop ring 14. Its upper end face frees the bores 16 and compressed air can flow into the return chamber from the working stroke chamber 32 through bores 16, and the sealing ring 18 functioning as check valve. As already mentioned, the return chamber 15 is connected to bore 56*a* through bores 58 and 58*a*. If this bore is closed (the throttling of bore 58 will be described more below), the described control valve means functions as single shot tool. As long as trigger lever 26 is actuated, the working piston 12 remains in its lower deadpoint position. Upon releasing the trigger lever 26, the valve tappet 60 is lifted by the pressure spring 62 and the air pressure. By this, the auxiliary control space 65 is cut off from atmosphere. Contemporarily a pressure communication of the auxiliary valve space 65 with reservoir 21 is established so that again a pressure can be built up in main control space 39 which returns the main valve spool 37 in its closed position. By this, the working stroke chamber 32 is again connected with atmosphere, and the compressed air stored in the return chamber 15 returns the working piston 12 into its upper deadpoint position. By this, a state is achieved which is illustrated in FIG. 1.

If the trigger lever 26 remains actuated and the bore 58 leaves a flow area, the described control valve works as automatic valve. If the compressed air of the return chamber 15 flows through the bores 58 und 58*a* to bore 56*a* it is applied to the lower effective area 57*a* and to the polygonal lower effective area 66 of the lower portion of auxiliary valve spool 38, the lower portion of auxiliary valve spool urging the upper portion upwardly into the position shown in FIG. 4. By this, a pressure can be again built up in the main control space 39 through the bore 47 in the main valve spool 37 and the passage between the valve rod 54 and the control sleeve 48 and through the radial bores 50 as well by which the main valve spool 37 is returned to its closed position shown in FIG. 4. At the same time, the working stroke chamber 32 is connected with the vent passage 22 through the connection passage 31. The working piston 12 then can be returned by means of the stored air in the return chamber 15 to its upper deadpoint position. During the return stroke of working piston 12 the pressure in the return chamber slowly reduces so that the compressed air below the effective area 57*a* and the polygonal effective area 66 of piston portion 57 can flow back into the return chamber 15 through bores 58 and 58*a* in order to support the return of piston 12 (surplus air is vented to atmosphere by passing driving ram 13).

Due to the pressure drop in the return chamber 15, the force which holds the piston portion 56 decreses gradually until the pressure which is applied to the cyclindrical portion 53 of the upper part of auxiliary valve spool suffices to move the upper part upwardly in conjunction with the lower one. As soon as the cylindrical portion 53 leaves bore 55, the latter is at atmospheric pressure since also the auxiliary control space 65 is still connected to atmosphere. The main control space 39 thus is pressure-relieved so that the main valve spool can move upwardly again. A fresh working cycle commences.

Figure 2:
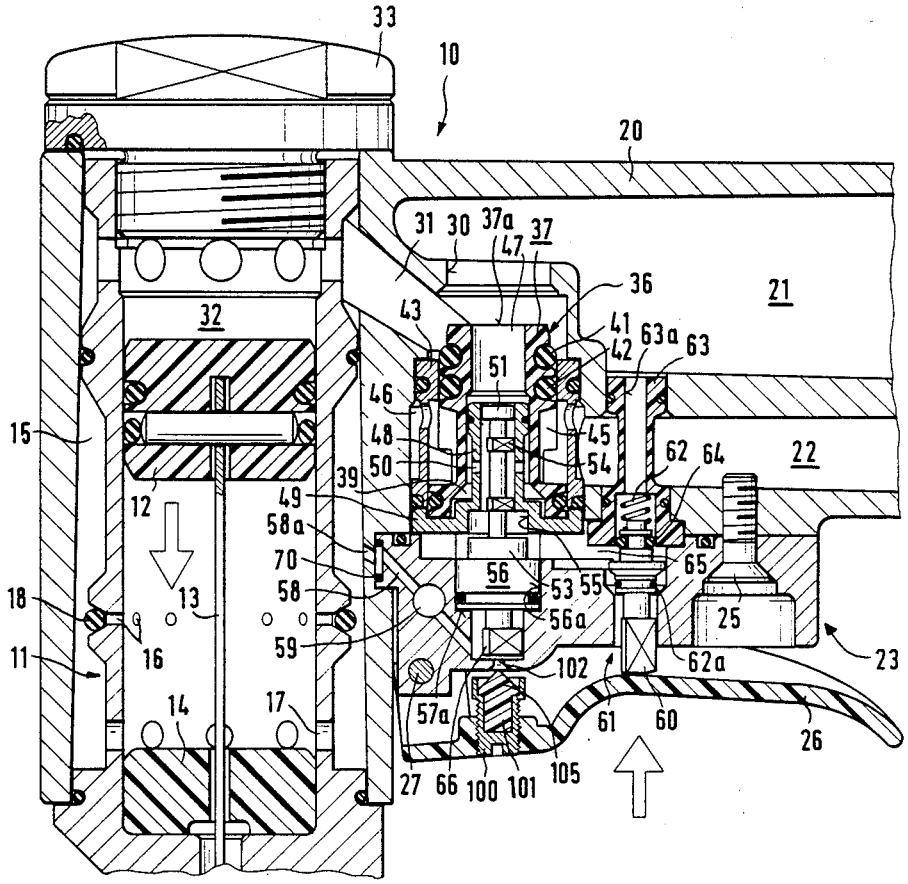
FIG. 2 shows the same valve means as FIG. 1, however, actuated for a single shot operation.
Figure 3:
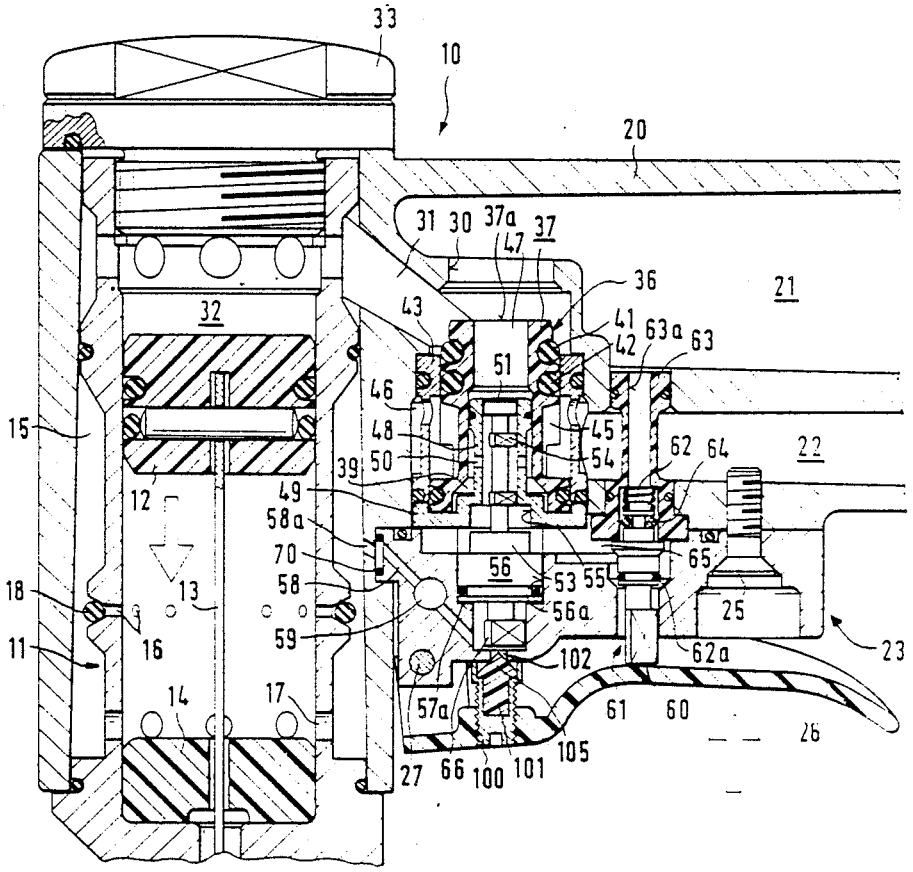
FIG. 3 shows the same valve means as FIG. 1, however, in a first phase after actuation.

As can be seen, plate 23 includes a connection bore 102 below bore 56*a* wherein the second part of auxiliary valve spool is arranged, the connection bore 102 normally is connected to atmosphere. A screw or a threaded sleeve 100 is located in a threaded bore of trigger lever 26, the bore of the threaded sleeve 100 receiving a cylindrical sealing element 101 of elastomeric material, the sealing element 101 having a conical tip 105 at its upper end. In the non-actuated state of trigger lever 26, bore 102 is free. If the trigger lever 26 is lifted as shown in FIG. 2 so that trigger valve 61 responds by plunging the sealing ring 64 in the respective bore 63*a*, but not so far that the conical tip 105 sealingly cooperates with bore 102, the release of the driving tool is initiated, however, only for single shot operation also if throttle 59 in the passage between the return chamber and the second effective area 57*a* is opened. The connection of the second effective area 57*a* to atmosphere effects that the auxiliary valve spool cannot initiate an automatic reverse of the main valve as long as bore 102 is connected to atmosphere. Only if trigger lever 26 is lifted farther as shown in FIG. 3, automatic operation is established. By this, a selective single shot and automatic operation can be accomplished in the operational mode "Automatic" which is determined by the throttle.

It is understood that also other of the shown sealing element can effect a sealing of bore 102, for example an annular seal.

Figure 6:
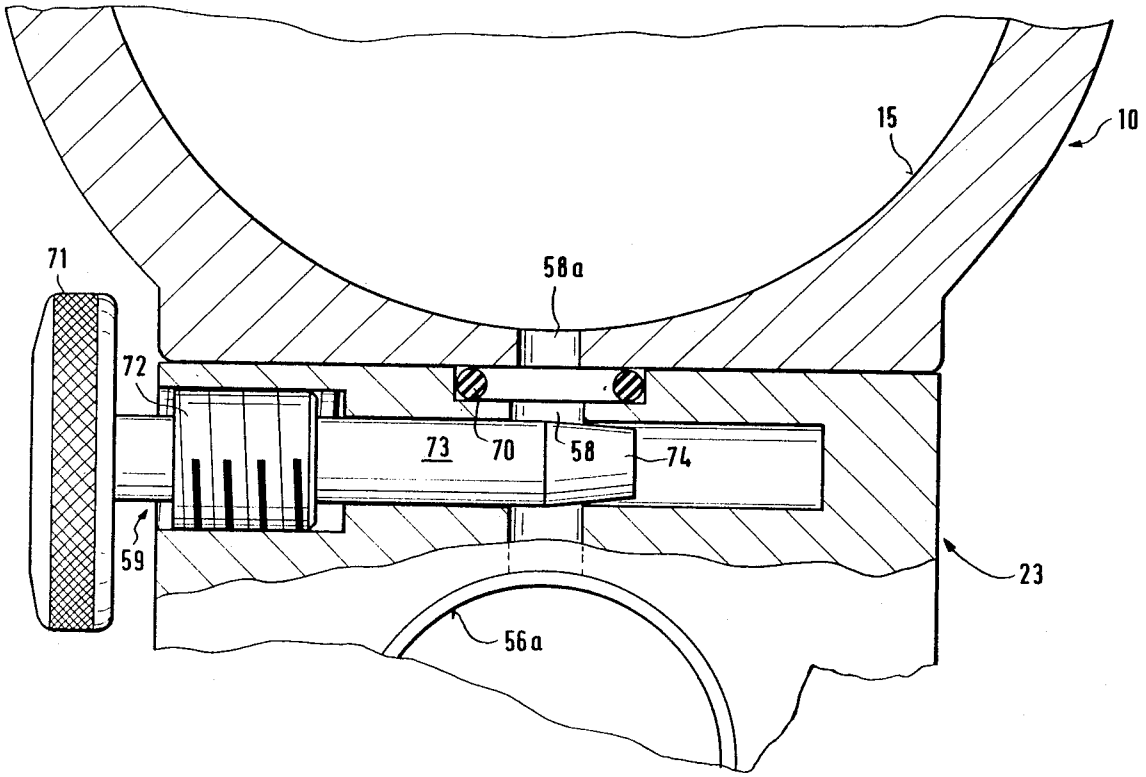
FIG. 6 shows a cross section through the valve means of FIG. 1 along line VI—VI.

FIG. 6 shows a cross section through housing 10 and a portion of valve plate 23 as well as the area of a sealing 70 through which the projection 24 is sealed against housing 10. As can be recognized, bore 58*a* connects return chamber 15 with bore 56*a* through bore 58. It can be seen further that throttle 59 cooperates with bore 58. It consists of a screw which includes a knurled knob 71, a threaded portion 72 and a throttling portion 73 which is conically formed at the end as shown at 74. By means of the throttling screw the size of the flow area through bore 58 can be arbitrarily adjusted. It determines the repetition frequency of the control valve.

The shown control valve has the following advantages. It works without dynamically loaded springs. The single spring is a pressure spring 62 for the trigger valve. However, it is not dynamically loaded. Further, the shown control valve is equipped with a small number of dynamically loaded O-rings. In the shown embodiment, only five O-rings are required dynamically loaded with the stroke frequency, a number which is exceeded by far with known control valves. For example, the upper part of the auxiliary valve spool 38 works completely without O-rings, and the lower part has only one O-ring.

The described control valve can be used for single shot and for repetition operation as well. During single shot operation, the lower part of the auxiliary valve spool remains in the lower position shown in FIG. 1. It is of particular importance that the shown control valve provides an adaptation to the run of the working piston 12. A reversal of the main valve spool towards its closed position takes place only when the working piston 12 has really reached the lower deadpoint position. By this, the completely available driving energy can be exploited. Conversely, the working stroke chamber 32 is supplied with the pressure of reservoir 21 only when the working piston 12 has really reached its upper deadpoint position.

Related to the effective area 52 of the upper part of the auxiliary valve spool 38, the piston portions 56 and 57 of the lower part have a particularly large effective area 57*a* and 66. Therefore, only a relatively small pressure suffices to hold the auxiliary valve spool 38 in its upper position so that a reversal takes place only when the working piston 12 has actually reached its upper deadpoint position.

As can be simply recognized, the described control valve can be mounted in conventional already operated devices. Merely bore 58 has to be made additionally.

We claim:

1. Control valve means for pressurized air-operated devices for driving fasteners into a workpiece by which a working cycle of a working piston is effected each working cycle having a single working stroke of the piston for driving-in a fastener which is followed by a return stroke, said device having further a piston return chamber to return said piston from a lower deadpoint position to an upper deadpoint position, said control valve comprising a pressure and vent passage connected to a working stroke chamber above said piston, a main control space, a pressure-controlled stepped main valve spool located in said pressure and vent passage and having a smaller effective area and a larger effective area, said smaller effective area selectively subjected to the pressure of a reservoir for compressed air in said device, said larger effective area in selective communication with said main control space for the control of subsequent working cycles alternatingly pressurized or vented, an auxiliary valve spool supported for movement coaxial of said main valve spool including a first effective area and a second effective area opposite to said first effective area, a trigger valve, said first effective area of said auxiliary valve spool being selectively connected to said pressure passage or to atmosphere by the actuation of said trigger valve, said second effective area of said auxiliary valve spool being connected to a passage through which a reverse pulse is supplied in order to displace said auxiliary valve spool into a second position, wherein said main control space is connected to said pressure passage in order to displace said main valve spool into its closed position, said auxiliary valve spool being returned into its first position by the pressure of said pressure passage if the pressure on said second effective area falls below a predetermined value, characterized in that said second effective area of said auxiliary valve spool is connected to said piston return chamber through a short passage including a throttle.

2. The control valve means of claim 1 wherein a throttle screw or the like is located in said passage.

3. The control valve means of claim 1 wherein the main valve spool has a central bore therethrough, a fixedly located control sleeve sealingly engaging said central bore, the control sleeve preferably having a radial flange confining the main control space, the auxiliary valve spool being guided in a bore of said sleeve.

4. The control valve means of claim 3, wherein the second effective area of the auxiliary valve spool is defined by a piston portion of the auxiliary valve spool sealingly guided in a cylindrical bore beyond the control sleeve and being significantly larger than the first effective area, preferably at least twice of the first effective area.

5. The control valve means of claim 3, wherein the first effective area of the auxiliary valve spool is defined by a piston portion, a further piston portion being provided at the auxiliary valve spool which sealingly cooperates with the bore of the control sleeve when the other piston portion is beyond the control sleeve bore in order to connect an auxiliary control space with said first effective area, said auxiliary control space being connected with compressed air if said trigger valve is non-actuated and connected to atmosphere if said trigger valve is actuated, both piston portions being smooth cylindrical portions without sealing elements which exclusively metallically seal in said control sleeve bore.

6. The control valve means of claim 5, wherein the piston portion of the auxiliary valve spool between said effective areas and the associated bore portion of said control sleeve has a greater diameter than said bore portion receiving said first effective area.

7. The control valve means of claim 5, wherein the portion between said piston portions of said auxiliary valve spool defines an annular space with said control sleeve, said annular space being connected to said main control space through a radial bore in said control sleeve.

8. The control valve means of claim 7, wherein said auxiliary valve spool in the area of said passage is polygonal in cross section, preferably triangular.

9. The control valve means of claim 4, wherein a third effective area of said auxiliary valve spool is continuously subjected to the pressure in said pressure passage, said third effective area is substantially smaller than said second effective area.

10. The control valve means of claim 5, wherein said auxiliary valve spool is comprised of two parts, one part having said cylindrical piston portions cooperating with said control sleeve, the other part having said second effective area, said piston portions having said second effective area and an opposite effective area facing said auxiliary control space.

11. The control valve means of claim 1, wherein a valve plate is provided supporting said trigger lever for said trigger valve, said valve plate including said passage for said connection to said return chamber and to said second effective area, said valve plate sealingly and slidably supporting said piston portion having said second effective area of said auxiliary valve spool in a bore and further supporting a tappet for said trigger valve in a further bore.

12. The control valve means of claim 1, wherein said second effective area of said auxiliary valve spool is connected to a bore directed to a trigger of said trigger valve which bore in the non-actuated position of said trigger is being connected to atmosphere, a portion of said trigger bearing a sealing element which upon actuation of said trigger sealingly closes said bore, said sealing element and said trigger valve being designed such that for the actuation of said trigger valve the trigger is moved a first length of travel out of its rest position and after a subsequent second length of travel the sealing element seals said bore, while said trigger valve remains activated.

13. The control valve means of claim 12, wherein an elastomeric sealing element is provided.

14. The control valve means of claim 13, wherein a plug-like sealing element is provided having a conical tip.

15. The control valve means of claim 14, wherein said sealing element is sitting in a bore of a screw which in turn is arranged in a threaded bore of said trigger.

* * * * *